United States Patent [19]

Morey et al.

[11] 4,066,393

[45] Jan. 3, 1978

[54] REUSABLE WATER SOFTENER SYSTEM FOR CLOTHES WASHER

[75] Inventors: Everett D. Morey, Louisville, Ky.; Eddie W. Dooley, Jeffersonville, Ind.

[73] Assignee: General Electric Company, Louisville, Ky.

[21] Appl. No.: 776,505

[22] Filed: Mar. 11, 1977

Related U.S. Application Data

[62] Division of Ser. No. 708,278, July 23, 1976.

[51] Int. Cl.[2] ..... B08B 3/00; D06F 39/00

[52] U.S. Cl. ..... 8/137; 68/13 A; 68/17 R; 68/18 FA; 210/167; 210/282

[58] Field of Search ..... 8/137; 68/13 A, 17 R, 68/18 FA; 210/167, 282

[56] References Cited

U.S. PATENT DOCUMENTS

| | | | |
|---|---|---|---|
| 2,380,732 | 7/1945 | Dunham | 68/13 A |
| 2,522,242 | 9/1950 | Wagner | 68/13 A |
| 3,023,132 | 2/1962 | Diamond et al. | 8/137 |
| 3,053,066 | 9/1962 | Dodd | 68/23 |
| 3,937,042 | 2/1976 | Loeb | 68/13 A |

*Primary Examiner*—A. Lionel Clingman
*Attorney, Agent, or Firm*—Frederick P. Weidner; Francis H. Boos

[57] ABSTRACT

A water softening system utilizing a reusable, self-contained water softener device for an agitator type clothes washer. The water softener device includes a quantity of cation exchange resin contained in a chamber. The water softener device is placed in the clothes washer in association with the agitator and water is percolated upwardly through the resin by a pump to thereby effect hardness reduction by the removal of calcium and/or magnesium ions from the water. After the softening operation, the water softener is removed from the washer and detergent and soiled fabrics are placed therein. The resin may then be regenerated by treatment of the device with a salt solution.

6 Claims, 4 Drawing Figures

REUSABLE WATER SOFTENER SYSTEM FOR CLOTHES WASHER

CROSS REFERENCE TO RELATED APPLICATION

This application is a Division of copending patent application Ser. No. 708,278 for "Reusable Water Softener System for Clothes Washer", filed July 23, 1976, in the names of Everett D. Morey and Eddie W. Dooley, and assigned to the assignee of this application.

BACKGROUND OF THE INVENTION

1. Field of the Invention:

The present invention relates to a water-softening system utilizing a reusable, self-contained water softener device and more particularly, to such a water softener device for use in a clothes washer for reducing the hardness of water therein.

2. Description of the Prior Art:

Ecological concern has resulted in legislation forbidding the use of polyphosphates as a detergent component in many geographical areas of our country. However, there are many areas of our country where the quality of water, and particularly the hardness, is such that poor clothes washing performance often results from the use of nonphosphate detergents. The generally recommended solution for the problem is the installation of a home water-softening system. This requires a substantial outlay of money on the part of the homeowner or lessor and as a result, people often are disposed to make do with the hard water situation as it is.

By the present invention, there is provided a low-cost means to soften water in agitator type clothes washers.

SUMMARY OF THE INVENTION

In accordance with the present invention, there is provided in a vertical axis clothes washer having a tub and agitator, a water softening system utilizing a reusable, self-contained, water softener device. The water softener device comprises a housing removably placed around the agitator and arranged for movement therewith. There is a reservoir at the top of the housing and located within the housing is a plurality of vertical channels radially disposed around the agitator and extending from the reservoir to the bottom of the housing. Means are provided to pump water from the tub into the reservoir. There is a resin containing chamber within the housing, the top of said chamber having a water outlet and the bottom a water inlet. A pump chamber is located between the bottom of each channel and the resin containing chamber and the pump chamber has pumping means to force the water upwardly through the resin and out the outlet. By this arrangement water will be percolated through the resin for removing calcium and magnesium ions from the water to effect a reduction of hardness of the water. The resin is of the type which is capable of regeneration by treatment with a salt solution.

It is therefore an object of the present invention to provide a water softening system for use in an agitator type of clothes washer wherein the system is efficient, of low cost and is reusable.

DESCRIPTION OF THE PREFERRED EMBODIMENT

Figure 1:
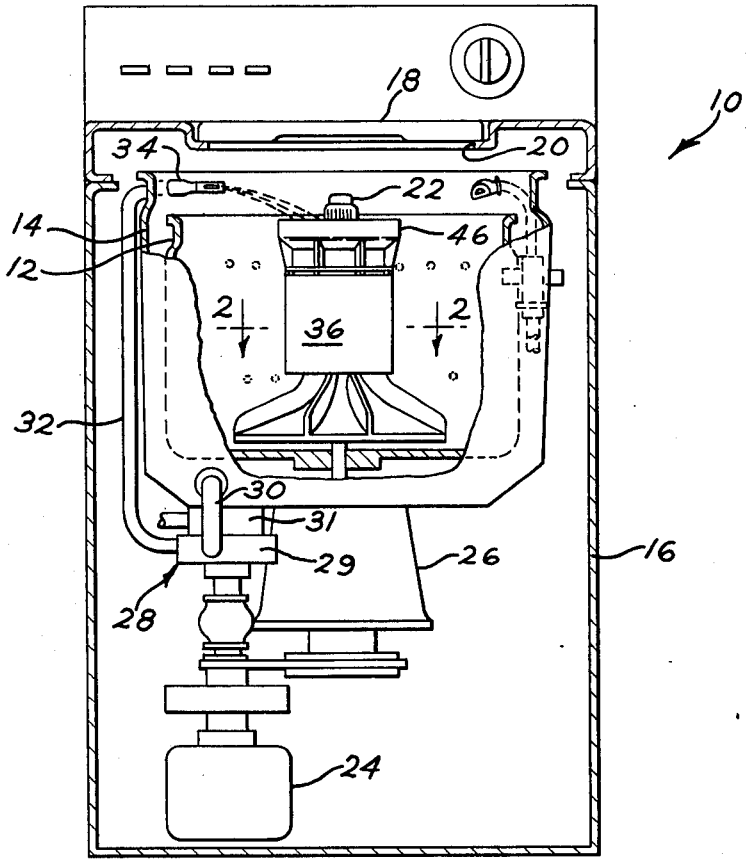
FIG. 1 is a front elevational view of an automatic clothes washing machine incorporating the preferred embodiment of the present invention, the view being partly in section and partly broken away to show certain operating components thereof.

Referring to FIG. 1, there is shown an agitator type clothes washer 10 of the vertical axis type having a conventional, perforated wash basket 12 disposed within an outer, imperforate, liquid-retaining tub 14. With this combination, the basket 12 and tub 14 form suitable means for containing water and fabrics to be washed in the water. The outer tub 14 is rigidly mounted within an appearance cabinet 16 which includes an access lid or cover 18 hingedly mounted on a hinge rod on the top portion of the cabinet 16 for providing access through an opening 20 to the basket 12.

At the center of the wash basket 12 is positioned an agitator 22 for agitating clothes during a washing operation. Conventionally, the basket 12 is mounted for rotation and the agitator 22 is mounted for oscillatory back and forth motion which will effect washing action on the clothes in the basket 12.

Basket 12 and agitator 22 are driven from a reversible motor 24 coupled by suitable means to a transmission 26. When the motor 24 is rotated in one direction, the transmission causes a slow speed oscillation of the agitator 22 and the basket is stationary and when the motor is driven in the opposite direction, the transmission 26 drives both basket 12 and agitator 22 at a high speed for centrifugal extraction of the water from the clothes.

In addition to operating the transmission 26 as described, motor 24 provides a direct drive to a pump structure 28 which includes two separate pumping units 29 and 31. During the high speed operation, pump unit 31 draws liquid from the outer tub 14 and discharges through a conduit 33 and thence to a household sewage disposal system. During wash or slow speed when the agitator 22 is oscillating, the pump unit 29 is operated simultaneously with the agitator 22 by a mutual drive means, in this case motor 24 and draws liquid in through conduit 30 from the tub 14 and discharges it through conduit 32 which extends up to and terminates at a nozzle 34 directed into basket 12. This then constitutes a water recirculation system for the washer 10 which, during the washing operation, is utilized for lint removal by directing water into a filter pan (not shown) positioned on top of the agitator 22. Water expelled from nozzle 34 passes into the water softening device 36 suitably mounted on agitator 22, the water softening device being provided with a central opening or bore having a circular cross section for telescoping over and mating with the agitator center post which has a complementary configuration to drivingly engage the water softening device and thereby impart oscillatory back and forth motion to the water softening device simultaneously with such movement of the agitator.

Figure 3:
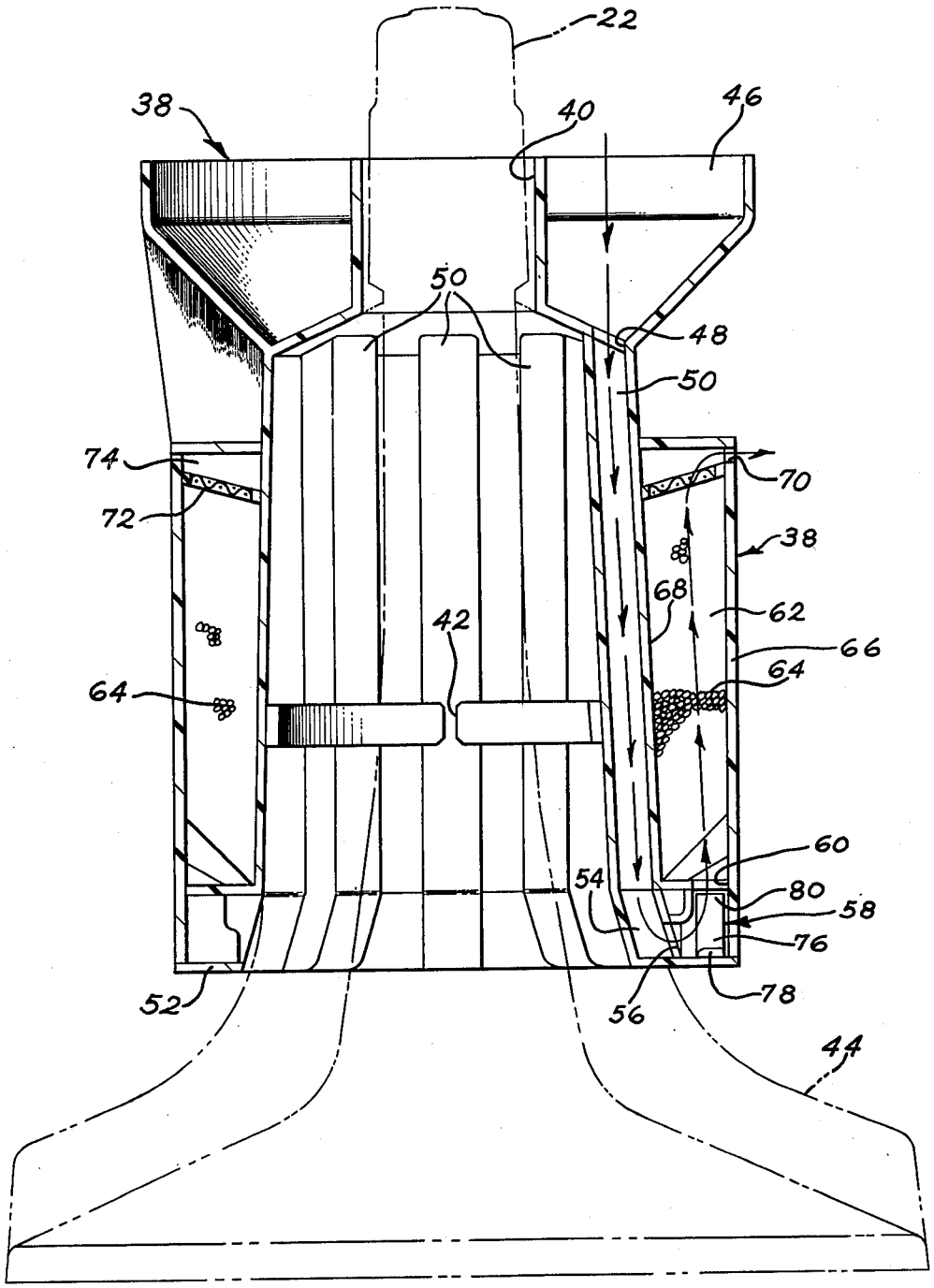
FIG. 3 is a view taken generally along the lines 3—3 of FIG. 2 and showing the front elevational view of certain portions of an automatic clothes washing machine broken away to more clearly show the structural arrangement of the preferred embodiment of the present invention relative to the agitator of the washing machine.
Figure 4:
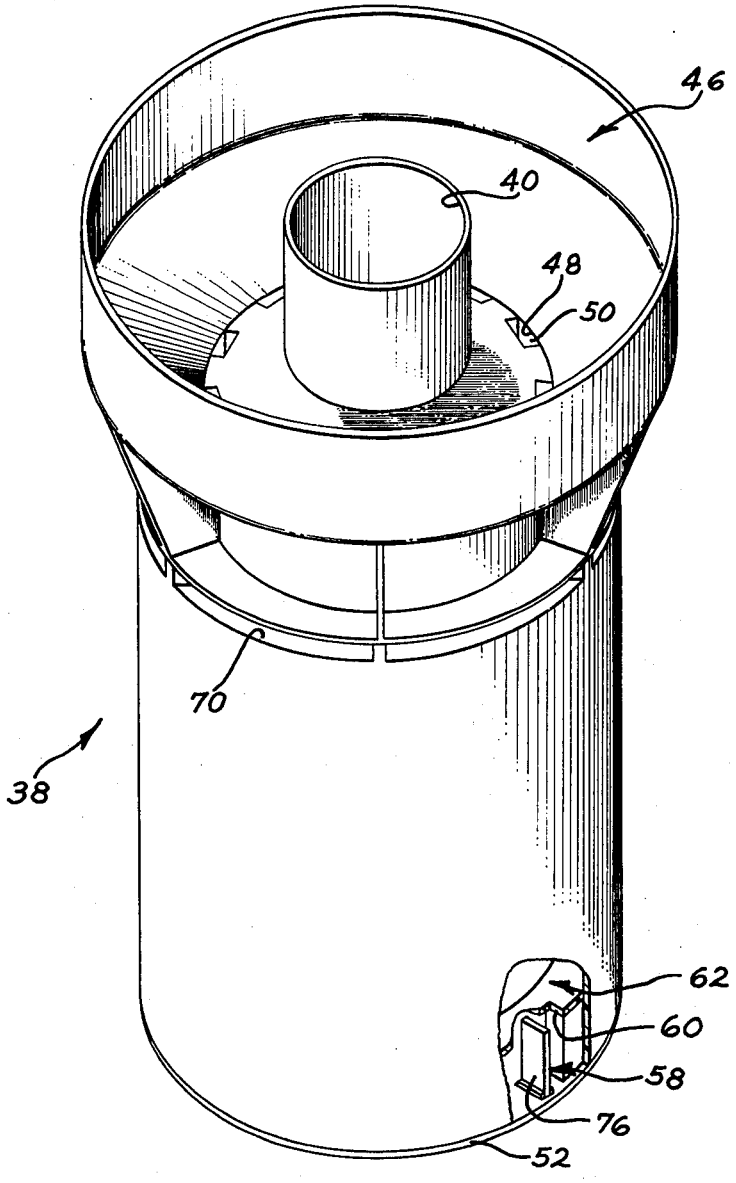
FIG. 4 is a perspective view partly broken away of the water softening device of the present invention.

In accordance with the present invention, in a preferred embodiment thereof, the water softening device 36 includes a housing 38 which in its preferred form is cylindrical in shape. The housing 38 has a vertical axial opening or bore 40 completely therethrough to allow the water softening device 36 to be telescoped over and removably placed around the agitator 22. The bore 40 is dimensioned to receive the contour of the agitator 22 as appropriate so that it may be seated upon the agitator as shown in FIG. 3 particularly. The side walls of the bore 40 have slots 42 to receive the agitator vanes 44 such that the water softening device 36 is structurally keyed to the agitator 22 so that it will move in unison with the agitator during the oscillatory back and forth movement of the agitator. The interior shape of the bore 40 will vary depending upon the shape of the agitator 22 with which it is intended to be used.

At the top of the housing there is a reservoir 46 which is dish shaped and is arranged to receive recirculating water being pumped back into the tub through nozzle 34. While the preferred embodiment recirculates water from the tub 14 to the reservoir 46 by a pump and conduit connected to the pump that is utilized in a clothes washer for recirculating wash water during the washing operation for lint removal purposes, such as by a lint filter placed on the top of agitator 22, other means may be employed, especially in washing machines not having a recirculating water filtering system. For instance, such recirculation of water from the tub 14 to the reservoir 46 could be a positive-displacement pump operated by the oscillatory movement of the agitator 22. In liquid flow communication through openings 48 in the base of the reservoir 46 is a plurality of interiorly located vertical channels 50 that extend from the openings 48 down to the bottom 52 of the housing. While there are a number of these channels 50 located radially around the agitator, they are identical and may, therefore, be described in terms of a single channel. Ideally there is a channel 50 for every space between the vanes 44 of the agitator 22. In the preferred embodiment illustrated there are 8 channels 50. The lower end 54 of the channel 50 is directed outwardly of the agitator and has an opening 56 that communicates with a pump chamber 58. Above the pump chamber and in liquid flow communication therewith through an opening 60 is located a resin containing chamber 62 that contains a body of cation exchange resin 64 in particle form. It will be noted that the resin containing chamber 62 is in the shape of a hollow cylindrical chamber having an outer wall 66 forming part of the housing 38 and an inner wall 68 which may also form one wall of the channels 50. Thus, the resin containing chamber 62 surrounds the vertical channels 50. The chamber 62 has a water inlet 60 leading from the pump chamber 58 and at the top of the resin containing chamber 62 a water outlet 70. To prevent the resin material 64 from passing out the outlet 70 with the water, a screen member 72 covers the top 74 of the resin containing chamber 62. Once the water has passed through the water softening device 36 it will flow into the washing machine tub and will again be recirculated as described heretofore.

The pump chamber 58 has located within it a pump means, which in the preferred embodiment is in the form of a thin, vertical, flexible fin 76 which is secured at its base 78 to the bottom wall 52 of the housing. The flexible fin 76 is constructed and arranged so that during oscillatory back and forth motion of the water softening device 38, the fin will flex back and forth at its top 80 thus exerting pumping force on the water within the pumping chamber 58 and thereby force the water up through the resin 64 in a percolating manner. This pumping force is additional to the hydrostatic head resulting from the water reservoir 46 being located several inches above the outlet 70 from the resin chamber 62. This pumping action is highly desirable as it is quite important to get good water contact with as much resin in a short period of time as possible. By this pumping action the water is forced upwardly through the resin so that it may more rapidly be returned to the washing machine tub whereupon it is once more circulated through the water softening device. Moreover, the better flow characteristics through the resin 64, the smaller the resin volume necessary to accomplish the desired softening of the water. By percolating the water upwardly through the resin there is a fluidized bed effect on the resin to reduce restriction of water passage through the resin as would occur if the water was forced downwardly through the resin causing it to be compacted.

Figure 2:
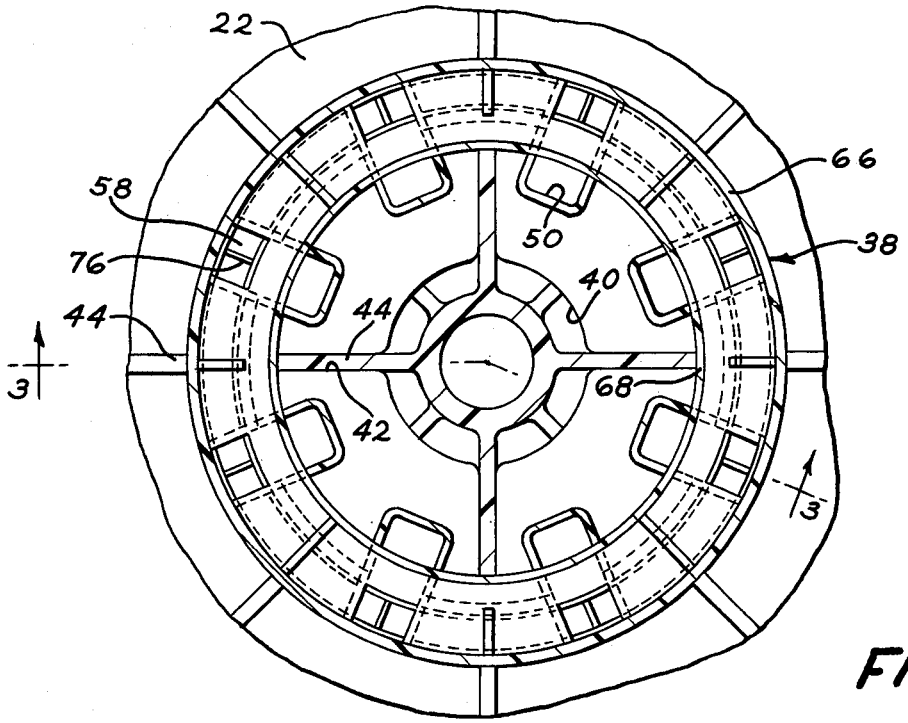
FIG. 2 is a view taken generally along the lines 2—2 of FIG. 1 and is partly broken away and partly in section.

The water softener device 36 utilizes cation exchange resins 64 as best seen in FIG. 2 such as, for example, strongly acidic resins. These resins are sold commercially by Rohm & Haas Company under the trade names Amberlite IR120 and Amberlite IR200, and by Dow Chemical Company under the trade names Dowex 50 and Dowex 50W. Such resins normally have a capacity in the order of about 30,000 grains of hardness as calcium carbonate ($CaCO_3$) per cubic foot.

In normal operation, an automatic washer such as shown in FIG. 1 has a wash-fill water volume of about 22 gallons. For most water supplies, a reduction of 15 grains of hardness per gallon would be sufficient to allow for good wash performance. When using a strong acid, cation exchange resin, such as Amberlite IR200, the total resin requirement would be a little over 20 cubic inches to effect such a hardness reduction, if proper contact between the resin and water can be achieved. The volume of the resin containing chamber 62 would be dimensioned accordingly.

The operational sequence, assuming fully regenerated resin is as follows:

1. Place water softener device 38 on the agitator 22 as shown in FIGS. 1 and 3 and washer 10 is filled with fresh water in the normal manner.

2. Start agitation with water recirculation and allow to continue for up to 15 minutes. During this step the water flow path through the water softening device 38 is shown by arrows in FIG. 3. Water being recirculated from the tub 14 through conduit 30 and pumped by pump unit 29 through conduit 32 out nozzle 34 flows into the reservoir 46 of the water softening device. From reservoir 46 the water passes through openings 48 in the bottom thereof down through vertical channels 50 into the pumping chambers 58. Due to the oscillatory back and forth motion being imparted to the water softening device 38 by the agitator 22, the top 80 of the thin flexible vane 78 is moved back and forth and imparts a force to the water in addition to the hydro- and imparts a force to the water in addition to the hydrostatic head pumping it through opening 60 into the resin chamber 62. The pumping force imparted by the flexible vanes forces the water to more readily pass through the resin material 64, through screen member 72 and out the opening 70 of the water softening device whereupon it will pass back to the tub where it will be recirculated again.

3. Stop machine and remove water softener device 38.

4. Add detergent and soiled fabrics and proceed through normal wash, rinse and spin cycles.

In effect, then, calcium and magnesium ions, the main contributors to hardness in water, have been removed by the resins in a manner well known to those skilled in the art. The resin 64 in the water softener device 38 should then be regenerated. Regeneration of the resin is accomplished by running a solution of sodium chloride in water through the device and the resin contained therein. Simple immersion of the exhausted resin in a salt solution cannot be expected to be of high efficiency since the displaced calcium and/or magnesium ions remain within the solution to compete with the sodium ions for sites on the resin matrix. Ideally, the displaced calcium and any magnesium ions should be removed from the solution as rapidly as possible after they are evolved thus allowing the regeneration reaction shown below to proceed more nearly to completion:

$$R_2{-}CA^{++} + 2Na^{+}\ 2R^{-}Na^{+} + Ca^{++}$$

where R is the resin matrix.

The water softener device disclosed herein is the preferred embodiment but its shape is not absolute and there are in fact many forms which the device may take which will allow, in an agitator type clothes washer, for the pumping action to provide passage of water upwardly through the resin for effecting a reduction in hardness thereof.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. The method of softening water for a vertical axis clothes washer having a tub and an agitator, comprising the following steps:

a. placing a water softening device around the agitator and attaching it to the agitator for movement therewith, said device having a housing with a reservoir at the top thereof for receiving water, a plurality of vertical channels radially disposed around the agitator and extending from the reservoir to the bottom of the housing, a cation exchange resin containing chamber within the housing, the top of said chamber having a water outlet and the bottom a water inlet, and a pump chamber located between the bottom of each channel and the resin containing chamber, said pump chamber having pumping means to provide water pumping force, b. introducing water into the tub, c. operating the agitator in an oscillatory back and forth motion thereby oscillating the water softener device, d. recirculating water from the tub into the reservoir of the water softener device during oscillation of the device, e. flowing water from the reservoir downwardly through the vertical channels to the bottom of the housing, f. pumping water from the bottom of the housing upwardly through the cation exchange resin to thereby remove calcium and magnesium ions from the water to effect a reduction of hardness of the water, and g. discharging the softened water from the water softening device into the tub.

2. The method of claim 1 wherein the step of recirculating water is by a pump operated simultaneously with the agitator by a mutual drive means.

3. The method of claim 1 wherein the step of pumping water from the bottom of the housing upwardly through the cation exchange resin is a thin, vertical, flexible fin that provides pumping force responsive to oscillatory back and forth movement of the water softener device.

4. The method of claim 3 wherein the step of pumping water upwardly through the resin by pumping means is by attaching the thin, vertical flexible fin to the bottom wall of the housing.

5. The method of claim 1 wherein after the step of pumping water upwardly through the resin, operation of the agitator is stopped and the water softening device is removed from te agitator.

6. The method of claim 5 wherein after the step of removing the water softening device from the agitator regenerating of the cation exchange resin is accomplished by treating the device with a sodium chloride salt solution.

* * * * *